United States Patent [19]

Perlin

[11] 4,372,297

[45] Feb. 8, 1983

[54] COMPRESSION DEVICE

[75] Inventor: Alfred R. Perlin, Highland Park, Ill.

[73] Assignee: The Kendall Company, Boston, Mass.

[21] Appl. No.: 210,889

[22] Filed: Nov. 28, 1980

[51] Int. Cl.[3] ..... A61H 1/00

[52] U.S. Cl. ..... 128/64; 128/DIG. 20

[58] Field of Search ..... 128/582, 327, DIG. 20, 128/24, 60, 64, 44

[56] References Cited

U.S. PATENT DOCUMENTS 2,896,612 7/1959 Bates ..... 128/60

3,201,111 8/1965 Afton ..... 128/DIG. 20

FOREIGN PATENT DOCUMENTS 836549 7/1952 ..... 128/DIG. 20

817521 7/1959 United Kingdom ..... 128/DIG. 20

*Primary Examiner*—Richard C. Pinkham

*Assistant Examiner*—T. Brown

*Attorney, Agent, or Firm*—Powell L. Sprunger

[57] ABSTRACT

A compression device comprising, a sleeve for placement about a patient's limb, with the sleeve having an inflatable chamber. The device has a pump communicating with the chamber for inflating the chamber, and a bladder having an inflatable cavity communicating with the pump. The effective volume of the bladder cavity which communicated with the pump may be adjusted by a suitable device.

12 Claims, 3 Drawing Figures

COMPRESSION DEVICE

BACKGROUND OF THE INVENTION

The present invention relates to therapeutic and prophylactic devices, and more particularly to devices for applying compressive pressures against a patient's limb.

It is known that the velocity of blood flow in a patient's extremities, particularly the legs, markedly decreases during confinement of the patient. Such pooling or stasis of blood is particularly pronounced when the patient has been confined to bed for extended periods of time. It is also known that stasis of blood is a significant cause leading to the formation of thrombi in the patient's extremities, which may have a severe deleterious effect on the patient, including death. Additionally, in certain patients it is desirable to move fluid out of interstitial spaces in extremity tissues, in order to reduce swelling associated with edema in the extremities.

SUMMARY OF THE INVENTION

The principal feature of the present invention is the provision of an improved device for applying compressive pressures against a patient's limb.

The compression device comprises, a sleeve for placement about a patient's limb, with the sleeve having an inflatable chamber. The device has a pump communicating with the chamber for inflating the chamber, and a bladder having an inflatable cavity communicating with the pump.

A feature of the present invention is that the pump may be operated to sequentially inflate and deflate the sleeve chamber.

Another feature of the invention is the provision of means for adjusting the effective volume of the bladder cavity which communicates with the pump.

Thus, yet another feature of the invention is that the effective pressure produced by the pump in the sleeve chamber may be controlled through use of the adjusting means.

Further features will become more fully apparent in the following description of the embodiments of this invention and from the appended claims.

DESCRIPTION OF THE PREFERRED EMBODIMENTS

Figure 1:
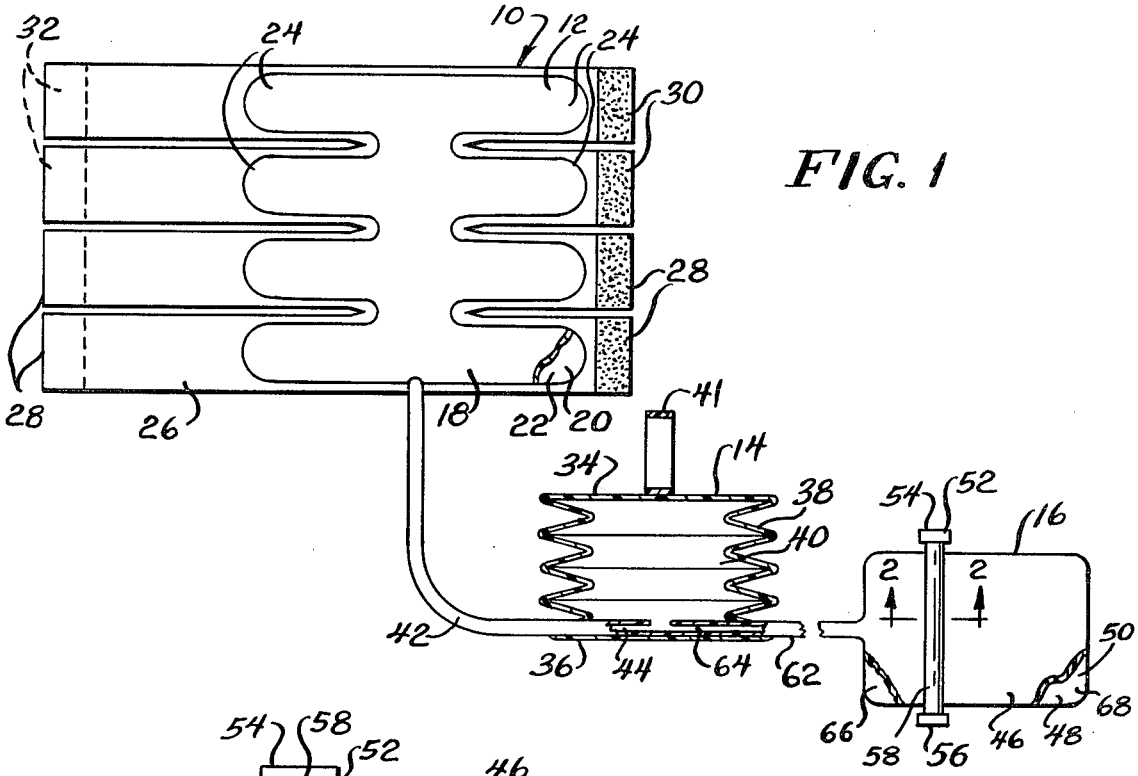
FIG. 1 is a fragmentary plan view, taken partly in section and partly broken away, of a compression device of the present invention.

Referring now to FIG. 1, there is shown a compression device generally designated 10 having an inflatable sleeve 12, a pump 14, and an inflatable bladder 16. The sleeve 12 has a front wall 18 and a back wall 20 of flexible material, such as a suitable plastic, joined at the periphery of the front and back walls 18 and 20 to define an inflatable chamber 22. As shown, the front and back walls 18 and 20 may have a plurality of spaced fingers 24 at opposed ends of the inflatable portion of the sleeve 12. The sleeve 12 has a relatively inextensible sheet 26, such as a suitable fabric, secured to the back wall 20, with the sheet 26 having a plurality of straps 28. The sheet 26 has a plurality of hook fastening strips 30 at one end of the straps 28, and a plurality of loop fastening strips 32 at the other end of the straps 28, such that the hook fastening strips 30 may be releasably attached to the loop fastening strips 32 in order to secure the sleeve 12 about the limb of a patient.

The pump 14 has a top wall 34, a bottom wall 36, and a flexible side wall 38 extending between the top wall 34 and the bottom wall 36. As shown, the side wall 38 is corrugated in order to define a bellows, with the top wall 34, bottom wall 36, and side wall 38 defining a chamber 40 in the pump 14. The pump 14 has a strap 41 secured to opposed sides of the top wall 34 for a purpose which will be described below. The top wall 34, bottom wall 36, and side wall 38 may be constructed of any suitable plastic material, such as polyethylene. The compression device 10 has a conduit 42 connected between the inflatable portion of the sleeve 12 and the pump 14, such that a lumen 44 in the conduit 42 communicates between the chamber 22 in the sleeve 12 and the chamber 40 in the pump 14.

Figure 2:
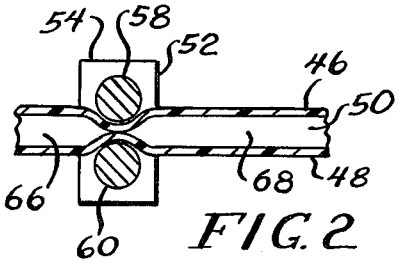
FIG. 2 is a fragmentary sectional view taken substantially as indicated along the line 2—2 of FIG. 1.

With reference to FIGS. 1 and 2, the bladder 16 has a top wall 46 and bottom wall 48 constructed from flexible material, such as a suitable plastic material, with the top wall 46 and bottom wall 48 being joined at their periphery to define a cavity 50 intermediate the top wall 46 and the bottom wall 48. The compression device 10 has a clamp 52 comprising a pair of spaced support members 54 and 56, and a pair of rollers 58 and 60 having opposed ends rotatably mounted on the support members 54 and 56. As shown, the rollers 58 and 60 are generally aligned, and are closely spaced to receive the top wall 46 and bottom wall 48 of the bladder 16 between the rollers 58 and 60, with the rollers 58 and 60 extending laterally across the bladder 16, and with the rollers 58 and 60 clamping the bladder top wall 46 and bladder bottom wall 48 together in order to close the cavity 50 between the rollers 58 and 60. The compression device 10 has a conduit 62 communicating between the pump 14 and the bladder 16, with a lumen 64 in the conduit 62 communicating between the chamber 40 in the pump 14 and the cavity 50 in the bladder 16. As will be apparent, the clamp 52 separates the cavity 50 into a first portion 66 which communicates with the conduit 62, and a second portion 68 which is closed by the clamp 52 from the conduit 62. The clamp 52 is movable longitudinally along the bladder 16 with the rollers 58 and 60 rotating in the support members 54 and 56 in order to enlarge or decrease the effective volume of the first cavity portion 66 which communicates with the conduit 62 and the pump 14.

Thus, the clamp 52 may be utilized to adjust the volume of the first cavity portion 66 which communicates with the pump 14. As a result, modification of the size of the first cavity portion 66 controls the effective pressure generated in the sleeve 12 when the pump 14 is operated by squeezing the bellows. If the effective volume of the first cavity portion 66 is decreased, the effective pressure generated by the pump 14 in the sleeve 12 will be increased. Alternatively, if the effective volume of the first cavity portion 66 communicating with the pump 14 is increased, the effective pressure generated by the pump 14 will be decreased in the sleeve 12. In this manner, the effective pressure generated in the sleeve 12 during operation of the pump may be controlled through movement of the clamp 52 longitudinally along the bladder 16. In a preferred form, an incompressible fluid, such as water, is used in the sleeve chamber 22, pump chamber 40, and bladder cavity 50.

Figure 3:
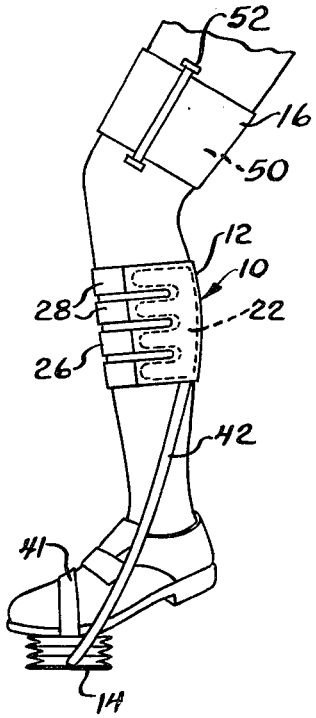
FIG. 3 is a perspective view of the compression device as positioned upon a patient's leg.

With reference to FIG. 3, the sleeve 12 may be secured about the patient's limb, in this case the leg, through use of the hook and loop fastening strips 30 and 32. The clamp 52 may be adjusted to a longitudinal position on the bladder 16 in order to obtain the desired pressure in the sleeve 12 when the pump 14 is operated, and the bladder 16 may then be wrapped around the patient's limb in order to retain it in place, such as by tape strips. Finally, the strap 41 of the pump 14 may be placed about the patient's foot, such that the pump 14 is located beneath the patient's foot and the pump 14 is squeezed to generate the selected pressure in the sleeve 12 when the patient steps upon the pump 14 by the patient's foot. Alternatively, the pump 14 expands when the patient lifts his foot during walking in order to deflate the sleeve 12. Thus, the pump 14 is operated to sequentially inflate and deflate the sleeve 12 while the patient walks, with the clamp 52 on the bladder 16 controlling the effective pressure generated in the sleeve 12 by the pump 14.

The foregoing detailed description is given for clearness of understanding only, and no unnecessary limitations should be understood therefrom, as modifications will be obvious to those skilled in the art.

I claim:

1. A compression device, comprising:

a sleeve for placement about a patient's limb, said sleeve having an inflatable chamber;

a pump communicating with said chamber for inflating the chamber;

a bladder having an inflatable cavity communicating directly with the pump; and means for adjusting the effective volume of said bladder cavity which communicates with said pump.

2. The device of claim 1 wherein said pump comprises a bellows.

3. The device of claim 1 including a conduit communicating between said pump and sleeve.

4. The device of claim 1 including a conduit communicating between said pump and bladder.

5. The device of claim 1 wherein said bladder has a pair of opposed flexible walls defining said cavity.

6. The device of claim 5 wherein the adjusting means comprises means for clamping said walls together laterally across the bladder, with the clamping means being movable longitudinally along the bladder.

7. The device of claim 6 wherein the clamping means comprises a pair of aligned rollers, and means for supporting the rollers in a closely spaced relationship with said walls located between the rollers and with the walls contacting each other between the rollers.

8. The device of claim 7 wherein the supporting means rotatably supports said rollers.

9. The device of claim 1 wherein said sleeve has a plurality of spaced inflatable fingers extending toward opposed ends of the sleeve.

10. The device of claim 1 wherein said sleeve includes a sheet of relatively inextensible material secured to a back portion of the sleeve, said sheet having means for securing the sheet about the patient's limb.

11. The device of claim 1 wherein said pump sequentially inflates and deflates said sleeve.

12. The device of claim 11 wherein said pump is manually operable to inflate and deflate said sleeve.

* * * * *